United States Patent [19]

Hanson

[11] Patent Number: 4,905,847

[45] Date of Patent: Mar. 6, 1990

[54] DISPLAY SHELF SYSTEM

[75] Inventor: Charles G. Hanson, Kansas City, Mo.

[73] Assignee: Stuart Hall Company, Inc., Kansas City, Mo.

[21] Appl. No.: 193,168

[22] Filed: May 2, 1988

Related U.S. Application Data

[63] Continuation of Ser. No. 9,839, Feb. 2, 1987, abandoned.

[51] Int. Cl.[4] ..... A47F 5/00

[52] U.S. Cl. ..... 211/184; 211/DIG. 1

[58] Field of Search ..... 211/184, 59.2, 59.4, 211/DIG. 1, 153, 134, 186, 43, 11; 108/60, 61; 312/45

[56] References Cited

U.S. PATENT DOCUMENTS

| | | | |
|---|---|---|---|
| 2,693,192 | 11/1954 | James | 211/DIG. 1 X |
| 2,702,553 | 2/1955 | Regenhard et al. | 211/DIG. 1 X |
| 4,183,438 | 1/1980 | Huczek | 211/184 X |

*Primary Examiner*—Alvin C. Chin-Shue
*Assistant Examiner*—Sarah A. Lechok
*Attorney, Agent, or Firm*—Harlan P. Huebner

[57] ABSTRACT

A display shelf system that includes at least one shelf that is preferably titled from the horizontal and dividers that are releasably secured to the shelf to segregate merchandise and said dividers include securement to affix the same to the shelf and indexing provided on the shelf and dividers to align and position said dividers with respect to said shelf.

2 Claims, 2 Drawing Sheets

DISPLAY SHELF SYSTEM

This is a continuation of copending application Ser. NO. 009,839, filed Feb. 2, 1987, now abandoned.

BACKGROUND OF THE INVENTION

1. Field of the Invention.

This invention relates to a display shelf system and particularly a divider or dividers that are primarily used on a shelf titled from the horizontal.

2. Description of the Prior Art.

Heretofore when shelves contain products of different size and dimensions there have been permanent or some form of fixed vertical dividers rising from the shelves to maintain the products therebetween.

There are some prior art shelves which have sliding dividers. That is the divider includes some form of hook that extends over the back of the shelf and butts against a front flange that runs the length of the shelf. The disadvantage of such a structure is that the fastening means to hold the dividers are required to be inserted each time in openings in the shelves. This is time consuming and if they are not used the divider can move and the merchandise divided thereby may not maintain a neat stacked appearance.

Another known prior art shelf and divider system is referred to as "wire binning". In this case the dividers for metallic shelves are parallel wires fences of different lengths. The dividers include feet that are set in openings in the shelf. The disadvantage of such dividers is that there are no open areas between dividers that face a customer and it is difficult to remove merchandise for purchase. Further, such binning divides are usually of metal and create a heavy appearance.

Additional dividers that are used are glass dividers that fit on horizontal shelves and are held together by top metallic clips. Again the disadvantage is access to merchandise therebetween.

SUMMARY OF THE INVENTION

It is a purpose of the present invention to provide a system with a divider for a shelf that is tilted at an angle from the horizontal and the divider will not become dislodged when products on the shelf bear against the divider.

It is another purpose of the present invention to provide a divider or dividers for a display shelf that can be releasably locked to the shelf and will maintain a product thereagainst in a neat stacked pleasing appearance.

A further object of the present invention is the provision of a shelf with a plurality of indexing holes and a divider that includes indexing pins therein for engagement with the mounting holes and securement means to releasably lock the divider to the shelf.

Another object of the present invention is to provide that the shelf is metallic and a magnetic piece is mounted on the divider for releasable locking engagement with the metallic shelf.

A still further object of the present invention is to provide shelf dividers of various configurations to be used as end dividers or middle dividers.

A yet another object of the present invention is to provide a light weight shelf divider of clear plastic which will not be so imposing as to detract from merchandise displayed on the shelf.

Another object of the present invention is to provide a shelf divider that is easy to insert and remove from a shelf yet will be rigid and fixed enough to prevent the intermingling of merchandise between one divider and another or the dislodgement of the same without force.

A further object of the present invention is to provide a system of a plurality of dividers on a tilted shelf to form areas possibly of different shapes and sizes to maintain merchandise such as stationery products.

These and other objects and advantages will become apparent from the following part of the specification wherein details have been described for the competence of disclosure, without intending to limit the scope of the invention which is set forth in the appended claims.

BRIEF DESCRIPTION OF THE DRAWINGS

These advantages may be more clearly understood from the following detailed description and by reference to the drawings in which.

DETAILED DESCRIPTION OF THE PREFERRED EMBODIMENT

Figure 1:
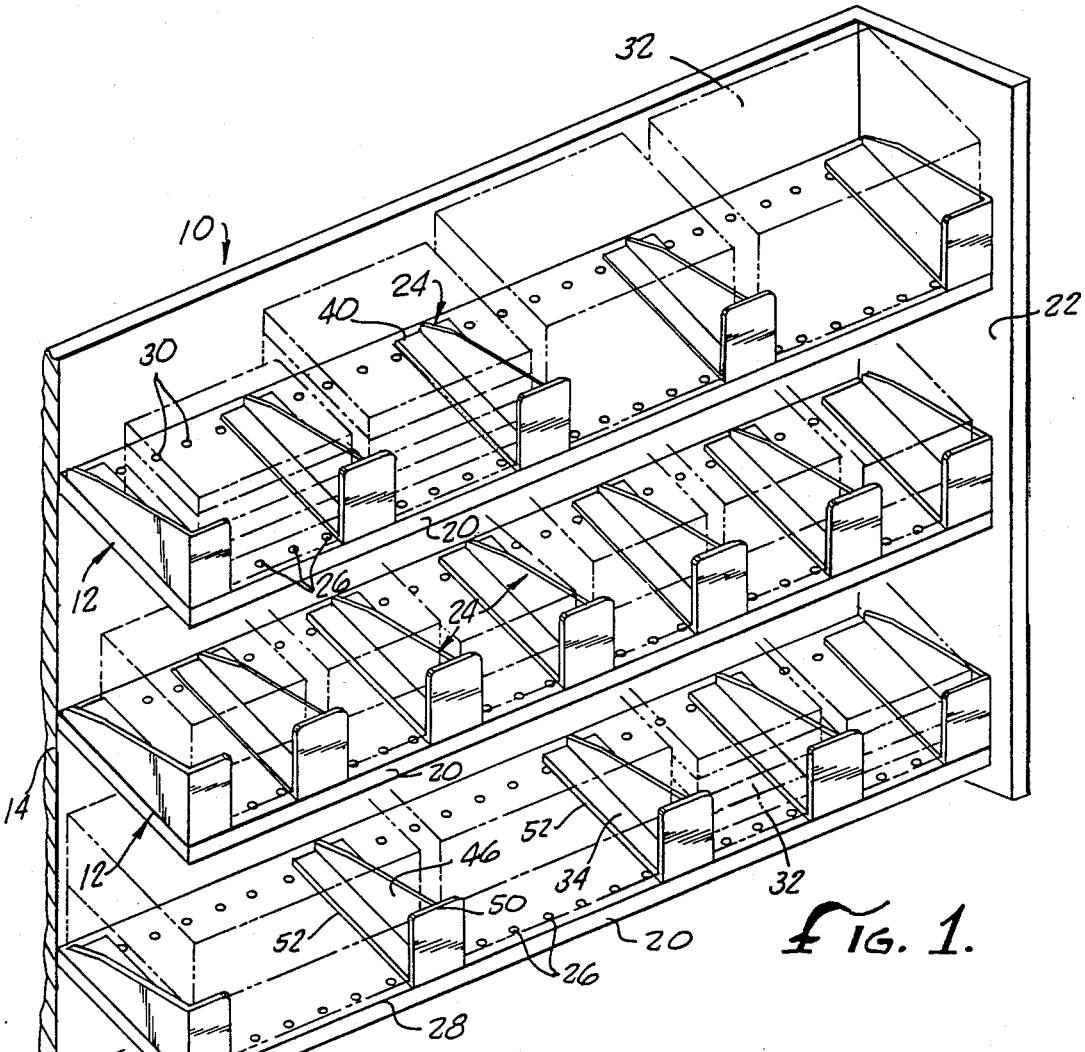
FIG. 1, is perspective view of a system of a plurality or tilted display shelve with a number of movable shelf dividers mounted on the respective shelves.

Now referring to the drawings there is illustrated in FIG. 1 a display shelf system generally designated 10.

The system 10 preferably includes a number of shelves generally designed 12, one above the other, that can either be mounted directly to a building wall 14 or could be attached to a vertical sheet or wall (not shown) or other mounting means separate from wall 14.

Figure 2:
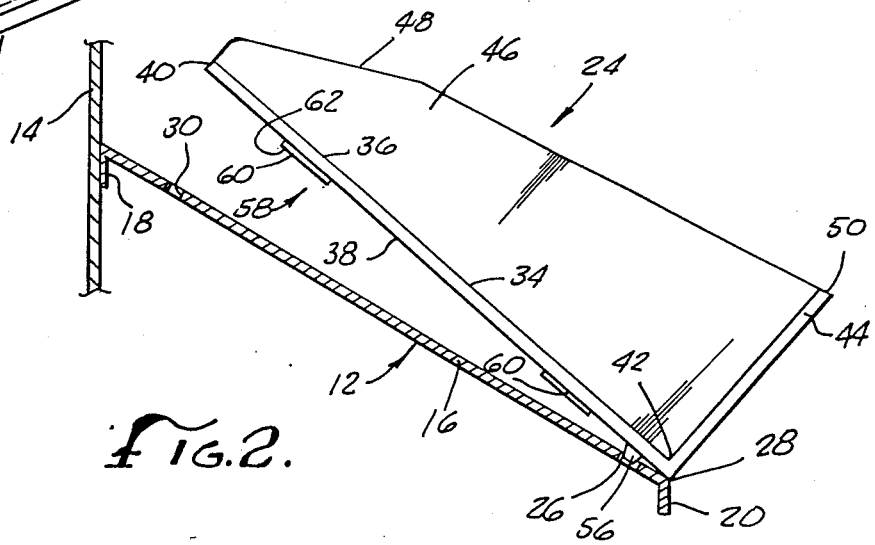
FIG. 2 is a side elevational view of a shelf divider to be mounted on a tilted shelf shown in section wherein the divider is being indexed.
Figure 3:
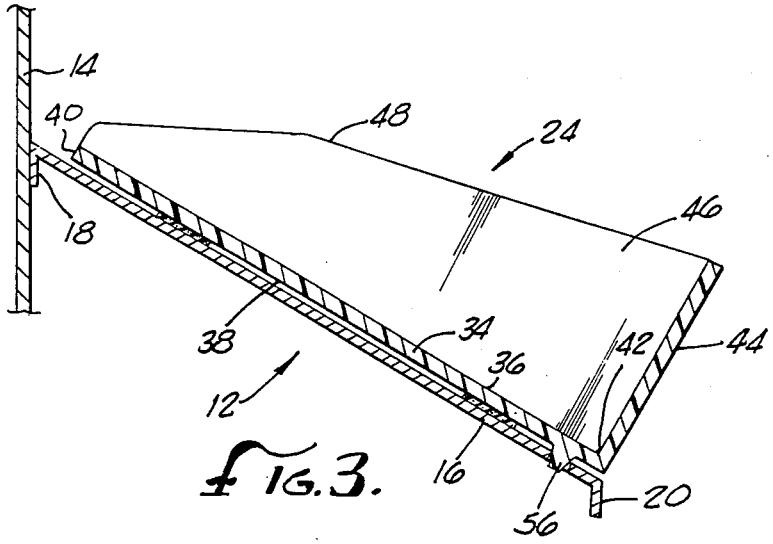
FIG. 3 is a view similar to FIG. 2 with the shelf divider fixed and fully mounted to the tilting shelf.

Each shelf 12 preferably includes a shelf portion 16 which extends forward from an elongated downwardly depending attachment flange 18, best seen in FIGS. 2 and 3 which is attached by any conventional means to the wall 14. The shelf portion 16 may be of any depth extending forwardly of the flange 18 and terminating in a front downwardly depending flange 20 to create a finished shelf. Each shelf portion 16 may also be of a length intended to fit into a given area. The lengths can vary depending upon the structural integrity of the material used, the weight of merchandise placed thereon and the area or space into which the shelf is to fit.

In FIG. 1 there is included for the sake of illustration an end wall 22 which is normal to the plane of wall 14.

Preferably each shelf 12 is formed of metal. In addition, in order to accommodate the shelf dividers generally designated 24 there are preferably a plurality of indexing holes 26 each in spaced relationship one from the other adjacent the front end edge 28 of the shelf portion 16 and along the entire length of the portion 16.

There also may be a plurality of rear indexing holes 30 aligned with the front indexing holes 26.

Turning now to the shelf dividers 24 each is preferably formed of a clear plastic. The use of a clear plastic for dividers will keep from detracting from the merchandise 32 illustrated in phantom lines such as notebooks, envelops, writing tablets or any other type of merchandise where it is desirable to have dividers to maintain a neat division thereof.

When as here the shelf portions 16 are preferably tilted it is necessary to assure proper positioning of dividers 24 so they are releasably locked. It has been found that at points of sales with the use of tilted shelving, that is shelving angled downwardly from the horizontal at approximately 30° to 60° more eye contact of the entire merchandise is possible and greater sales appeal is created.

Illustrated in FIGS. 1, 4, 5 and 6 are dividers for three uses with merchandise 32 on shelving that is left and right ends and center type.

Each divider 24 includes a base or floor 34 which is elongated having a top surface 36, a bottom surface 38 and rear end edge 40. At the front edge 42 of the bottom 34 there is an upward merchandise stop wall 44 which is normal to the plane of the bottom 34. The purpose of wall 44 is to prevent the merchandise 32 positioned between dividers 24 from falling forward out of the tilted shelving.

Each of the shelf dividers 24 also include a vertical divider wall 46 which extends from the end 40 of bottom 34 to and preferably is fused to the front stop wall 44. The top edge 48 of wall 46 may be of any configuration such as extending angularly, see FIG. 2 or at a smooth uninterrupted angle from end 40 to top 50 of the front wall 44.

As stated before three styles of dividers 24 may be used. In the case of a divider for the left end of the shelf system 10, see FIG. 4 the vertical divider wall 46 is positioned adjacent edge 52 of the bottom or base 36. There is a uniting of the left marginal edge wall 46 and stop wall 44 on the left edge.

Figure 5:
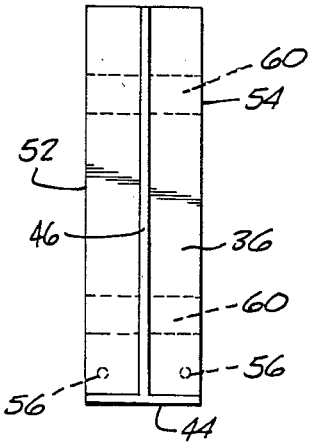
FIG. 5 a top plan view of a center divider adapted for use with merchandise on either side thereof.

For center type of dividers 24 such as seen in FIG. 1 and particularly FIG. 5 the vertical divider wall 46 is centrally located between edges 52 and 54 and generally parallel therewith.

Figure 4:
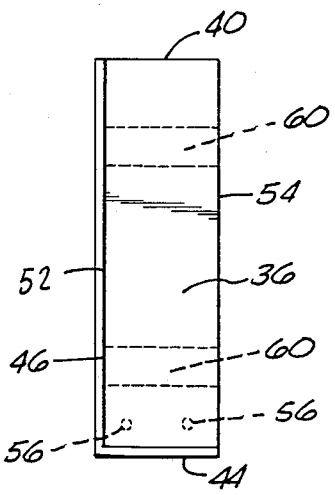
FIG. 4 is a top plan view of a left end divide to accommodate merchandise on the right side thereof and to finish off the left end of shelf.
Figure 6:
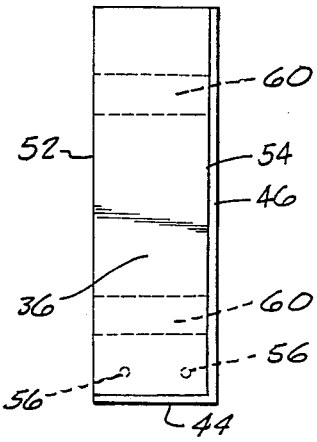
FIG. 6 is a top plan view of a right end divider to accommodate merchandise on the left side thereof and to finish off the right end of a shelf.

The right end divider, best seen in FIG. 6 is constructed in a similar manner to the left end divider of FIG. 4 except the divider wall 46 is positioned adjacent edge 54 of the base 34.

With constructions just described it is possible to finish off the right and left edges or ends of a shelf and divider system where there is no permanent structure such as a wall.

In order to position the shelf dividers 24 on the shelves 12 each one is fitted with an indexing tab or detent 56, FIGS. 2 and 3, and can be seen in dotted lines in FIGS. 4, 5 and 6. The tab extends downward from the bottom surface 38 of the base 34. The preferred structure is to include two detents 56 across the base spaced so as to interfit with two indexing holes 26.

Each divider 24 is also fitted on the bottom surface 38 of the base 34 with one or more securement means 58 which are preferably magnetic tapes 60 that have one side glued or otherwise secured to the bottom 38 and the outer edge 62 is magnetized.

Thus, in operation when it is desired to position a divider 24, the tab 56 is placed into an index hole 26, see FIG. 2 and then the rear portion of the divider is pushed downward so that the magnetic tapes 60 will engage the metallic shelf portion 16. As can be seen with the two tapes 60 adjacent the respective ends 40 and 42 they both assure a positioning whereby the divider will remain relatively fixed and not easily dislodged with merchandise bearing there against.

Figure 7:
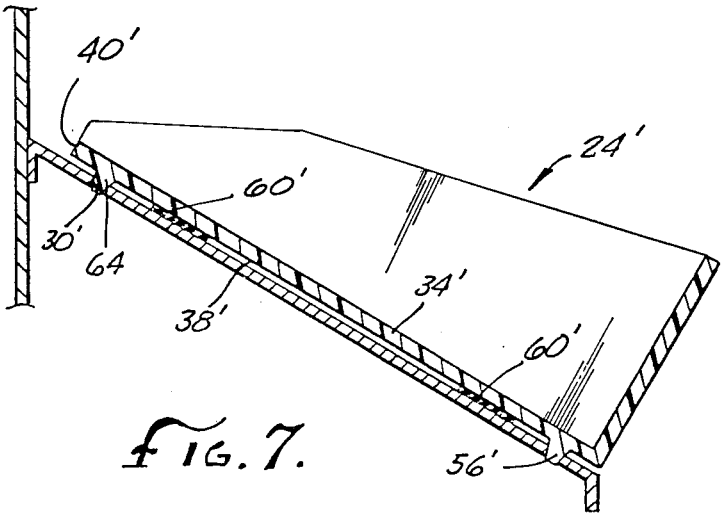
FIG. 7 is a side elevational view of a modified form of shelf divider counted on a tilted shelf.

In the modification of FIG. 7 the shelf divider 24' with base 34' has extending from the bottom surface 38' an additional tab or detent 64 or pair thereof adjacent upper end edge 40'. The purpose of the tab 64 is to engage rear indexing holes 30'. In this way additional accurate alignment may be achieved between adjacent shelf dividers 24'.

With regard to the modified divider 24' of FIG. 7 it is preferable to also utilize two securement means 60' such as the magnetic tapes.

As an alternative to employing full metallic shelves 12 as previously discussed it is also possible to form the shelves of other material and in any appropriate manner impregnate or form thereon a metallic strip along the shelf to coincide with the magnetic tops 60 for securement.

Finally, when it is desired to move the dividers 24 from one position to another, depending upon the size and shape of the merchandise the rear portion is lifted upwardly to disengage the magnet 60 and the divider 24 is removed.

While the invention has been illustrated and previously described as requiring indexing holes 26, the holes could be eliminated without departing from the spirit of the invention. In that case, the dividers 24 would not require the indexing tabs 56 and the dividers 24 would just be set on the shelves 12 and magnetically maintained.

The invention and its attendant advantages will be understood from the foregoing description and it will be apparent that various changes may be made in the form, construction and arrangements of the parts without departing from the spirit and scope thereof or sacrificing its material advantages, the arrangements herein before described being merely by way of example. I do not wish to be restricted to the specific forms shown or uses mentioned, except as defined in the accompanying claims, wherein various portions have been separated for clarity of reading and not for emphasis.

I claim:

1. A shelf and divider system to segregate merchandise wherein said system comprises:

a plurality of shelves each having a common depth and having opposed side ends, a front and rear edge defining said common depth therebetween, and said shelves each include at least a first indexing means in the form of a plurality of holes adjacent said front of each of said shelves and at least a portion of said shelves have a first metallic material;

at least a pair of merchandise divider numbers for each shelf of said system each having a front and rear end, and of a length generally corresponding to said depth of said shelf, a base of constant thickness throughout its mass and having a common plane throughout, an upright divider wall projecting upwardly from said base and having a top edge tapered from said front end toward said rear end of said divider whereby said top edge is non-parallel with the plane of said base, and each divider includes merchandise stop means in the form of a wall that rises from said base normal to the plane of said upright divider wall, second indexing means in the form of tabs depending from each of said bases of said dividers for engagement with a hole of said first indexing means to position said merchandise stop means at said front edge of each of said shelves, and two strips of magnetic tape extending across and downward from said base one adjacent said front end and the other strip adjacent said rear end of said divider, said strips each having a side that is fixedly secured to said bases of said dividers and each positioned so that opposed sides of said tapes are composed of magnetic material which may be releasably secured to said metallic material of said shelves to lock each of said dividers to a shelf whereby merchandise may be placed between said dividers and bear against said merchandise stop means; and each shelf angled relative to the horizontal and parallel to each other and the spacing between said shelves may be reduced to no greater than the height of said upright divider wall at said front end whereon said merchandise may be displayed.

2. A shelf and divider system as defined in claim 1 wherein each merchandiser member has two tabs depending from the base of each merchandiser member.

* * * * *